US010562734B2

(12) United States Patent
Honda

(10) Patent No.: US 10,562,734 B2
(45) Date of Patent: Feb. 18, 2020

(54) ROLL HOLDER, IMAGE FORMING APPARATUS, AND LIQUID DISCHARGE APPARATUS

(71) Applicant: Ryo Honda, Kanagawa (JP)

(72) Inventor: Ryo Honda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 156 days.

(21) Appl. No.: 15/913,809

(22) Filed: Mar. 6, 2018

(65) Prior Publication Data

US 2018/0257902 A1 Sep. 13, 2018

(30) Foreign Application Priority Data

Mar. 13, 2017 (JP) ..... 2017-047158

(51) Int. Cl.
*B65H 75/18* (2006.01)
*B41J 15/04* (2006.01)
*B65H 75/24* (2006.01)

(52) U.S. Cl.
CPC ..... *B65H 75/18* (2013.01); *B41J 15/04* (2013.01); *B65H 75/242* (2013.01); *B65H 2405/40* (2013.01)

(58) Field of Classification Search
CPC .. B65H 75/18; B65H 75/242; B65H 2405/40; B41J 15/04
See application file for complete search history.

(56) References Cited

U.S. PATENT DOCUMENTS 4,715,553 A * 12/1987 Hatakeyama ..... B65H 75/242 242/573.7
2005/0258301 A1* 11/2005 Hirte ..... B65H 16/04 242/597.6
2009/0194631 A1* 8/2009 Genta ..... B41J 11/001 242/576
2013/0206894 A1* 8/2013 Miyamoto ..... B65H 75/242 242/520
2014/0042262 A1* 2/2014 Li ..... B65H 75/246 242/571
2016/0130110 A1 5/2016 Honda et al.
2017/0217719 A1 8/2017 Honda

FOREIGN PATENT DOCUMENTS

JP 2007-290865 11/2007
JP 2013-100154 5/2013

* cited by examiner

*Primary Examiner* — Sang K Kim
(74) *Attorney, Agent, or Firm* — Duft & Bornsen, PC

(57) ABSTRACT

A roll holder is inserted with a hollow tube of one of a first roll having a first inner diameter and a second roll having a second inner diameter greater than the first inner diameter. The roll holder includes a holder and a cam assembly that are supported by a support shaft and movable in an axial direction of the support shaft. The cam assembly includes an abutment and a cam. The abutment contacts a lateral end of the second roll in the axial direction of the support shaft. The cam presses against one of a first presser and a second presser of the holder in a radial direction of the support shaft to cause the one of the first presser and the second presser to press against and hold an inner circumferential face of the hollow tube of the one of the first roll and the second roll.

14 Claims, 7 Drawing Sheets

ROLL HOLDER, IMAGE FORMING APPARATUS, AND LIQUID DISCHARGE APPARATUS

CROSS-REFERENCE TO RELATED APPLICATION

This patent application is based on and claims priority pursuant to 35 U.S.C. § 119 to Japanese Patent Application No. 2017-047158, filed on Mar. 13, 2017, in the Japanese Patent Office, the entire disclosure of which is hereby incorporated by reference herein.

BACKGROUND

Technical Field

Exemplary embodiments generally relate to a roll holder, an image forming apparatus, and a liquid discharge apparatus, and more particularly, to a roll holder for holding a rolled sheet, an image forming apparatus incorporating the roll holder, and a liquid discharge apparatus incorporating the roll holder.

Background Art

Related-art image forming apparatuses, such as copiers, facsimile machines, printers, or multifunction printers having two or more of copying, printing, scanning, facsimile, plotter, and other functions, form an image on a sheet with liquid or toner. The sheet is drawn out of a roll having a hollow tube serving as an axis. The image forming apparatus includes a roll holder that is compatible with rolls having various inner diameters of hollow tubes.

SUMMARY

This specification describes below an improved roll holder. In one embodiment, the roll holder is inserted with a hollow tube of one of a first roll having a first inner diameter and a second roll having a second inner diameter greater than the first inner diameter. The roll holder holds the one of the first roll and the second roll. The roll holder includes a support shaft, a holder, and a cam assembly. The holder is supported by the support shaft and movable in an axial direction of the support shaft. The holder includes a first roll holding portion to hold the first roll. The first roll holding portion includes a wedge to contact a lateral end of the first roll in the axial direction of the support shaft and a first presser being movable about the support shaft in a radial direction of the support shaft. The holder further includes a second roll holding portion to hold the second roll. The second roll holding portion includes a second presser that is movable about the support shaft in the radial direction of the support shaft. The cam assembly is supported by the support shaft and movable in the axial direction of the support shaft. The cam assembly includes an abutment and a cam. The abutment contacts a lateral end of the second roll in the axial direction of the support shaft. The cam moves to one of the first presser and the second presser when the one of the first roll and the second roll contacts corresponding one of the wedge and the abutment. The cam presses against the one of the first presser and the second presser in the radial direction of the support shaft to cause the one of the first presser and the second presser to press against and hold an inner circumferential face of the hollow tube of the one of the first roll and the second roll.

This specification further describes an improved image forming apparatus. The image forming apparatus includes a roll holder and an image forming device. The roll holder is inserted with a hollow tube of one of a first roll having a first inner diameter and a second roll having a second inner diameter greater than the first inner diameter. The image forming device forms an image on a sheet drawn out of the first roll and the second roll.

The roll holder holds the one of the first roll and the second roll. The roll holder includes a support shaft, a holder, and a cam assembly. The holder is supported by the support shaft and movable in an axial direction of the support shaft. The holder includes a first roll holding portion to hold the first roll. The first roll holding portion includes a wedge to contact a lateral end of the first roll in the axial direction of the support shaft and a first presser being movable about the support shaft in a radial direction of the support shaft. The holder further includes a second roll holding portion to hold the second roll. The second roll holding portion includes a second presser that is movable about the support shaft in the radial direction of the support shaft. The cam assembly is supported by the support shaft and movable in the axial direction of the support shaft. The cam assembly includes an abutment and a cam. The abutment contacts a lateral end of the second roll in the axial direction of the support shaft. The cam moves to one of the first presser and the second presser when the one of the first roll and the second roll contacts corresponding one of the wedge and the abutment. The cam presses against the one of the first presser and the second presser in the radial direction of the support shaft to cause the one of the first presser and the second presser to press against and hold an inner circumferential face of the hollow tube of the one of the first roll and the second roll.

This specification further describes an improved liquid discharge apparatus. The liquid discharge apparatus includes a roll holder and a liquid discharge head. The roll holder is inserted with a hollow tube of one of a first roll having a first inner diameter and a second roll having a second inner diameter greater than the first inner diameter. The liquid discharge head discharges liquid onto a sheet drawn out of the first roll and the second roll.

The roll holder holds the one of the first roll and the second roll. The roll holder includes a support shaft, a holder, and a cam assembly. The holder is supported by the support shaft and movable in an axial direction of the support shaft. The holder includes a first roll holding portion to hold the first roll. The first roll holding portion includes a wedge to contact a lateral end of the first roll in the axial direction of the support shaft and a first presser being movable about the support shaft in a radial direction of the support shaft. The holder further includes a second roll holding portion to hold the second roll. The second roll holding portion includes a second presser that is movable about the support shaft in the radial direction of the support shaft. The cam assembly is supported by the support shaft and movable in the axial direction of the support shaft. The cam assembly includes an abutment and a cam. The abutment contacts a lateral end of the second roll in the axial direction of the support shaft. The cam moves to one of the first presser and the second presser when the one of the first roll and the second roll contacts corresponding one of the wedge and the abutment. The cam presses against the one of the first presser and the second presser in the radial direction of the support shaft to cause the one of the first presser and the second presser to press against and hold an inner circumferential face of the hollow tube of the one of the first roll and the second roll.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
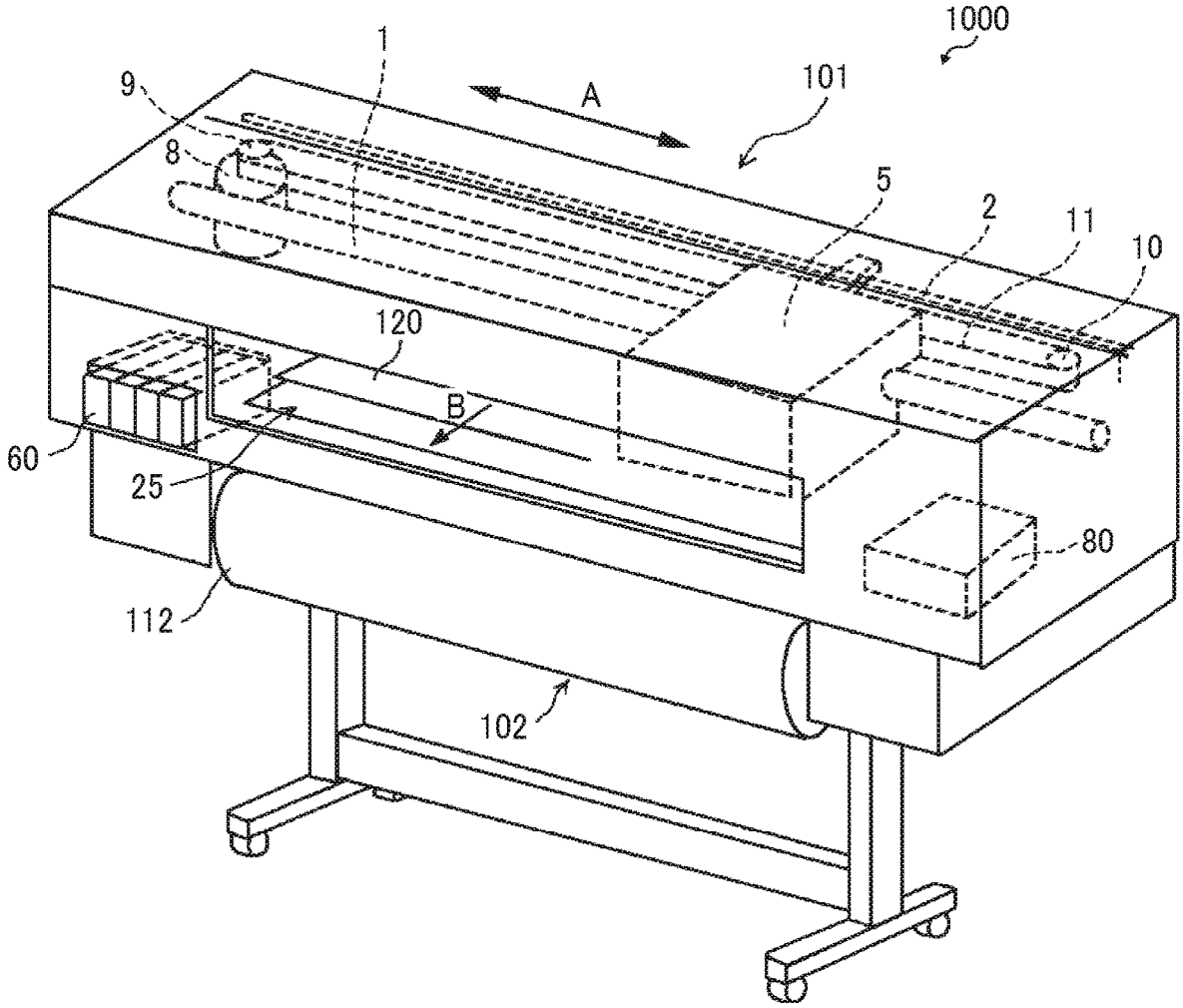
FIG. 1 is an external perspective view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1000 according to an embodiment is explained.

Figure 2:
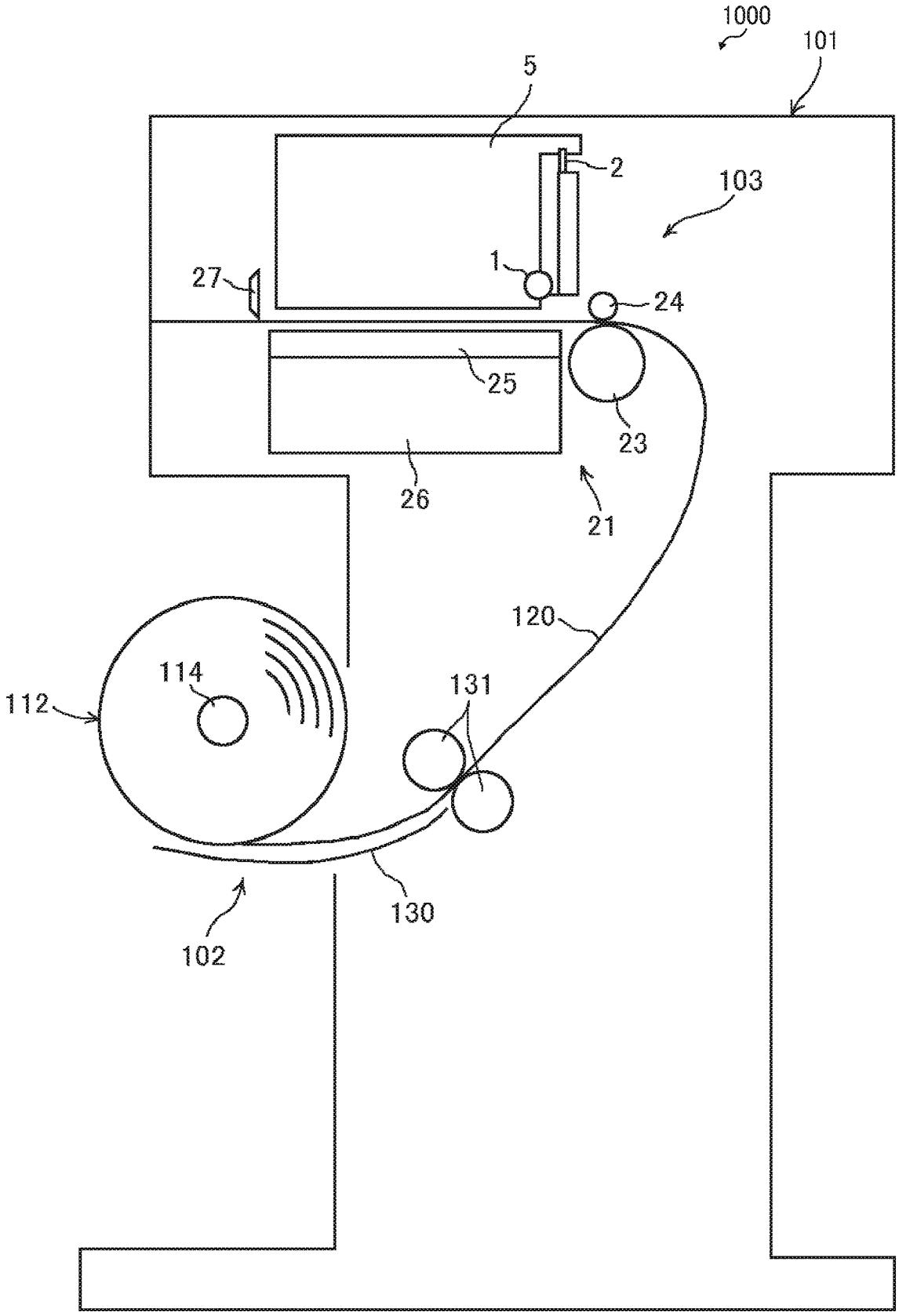
FIG. 2 is a cross-sectional side view of the image forming apparatus depicted in FIG. 1.
Figure 3:
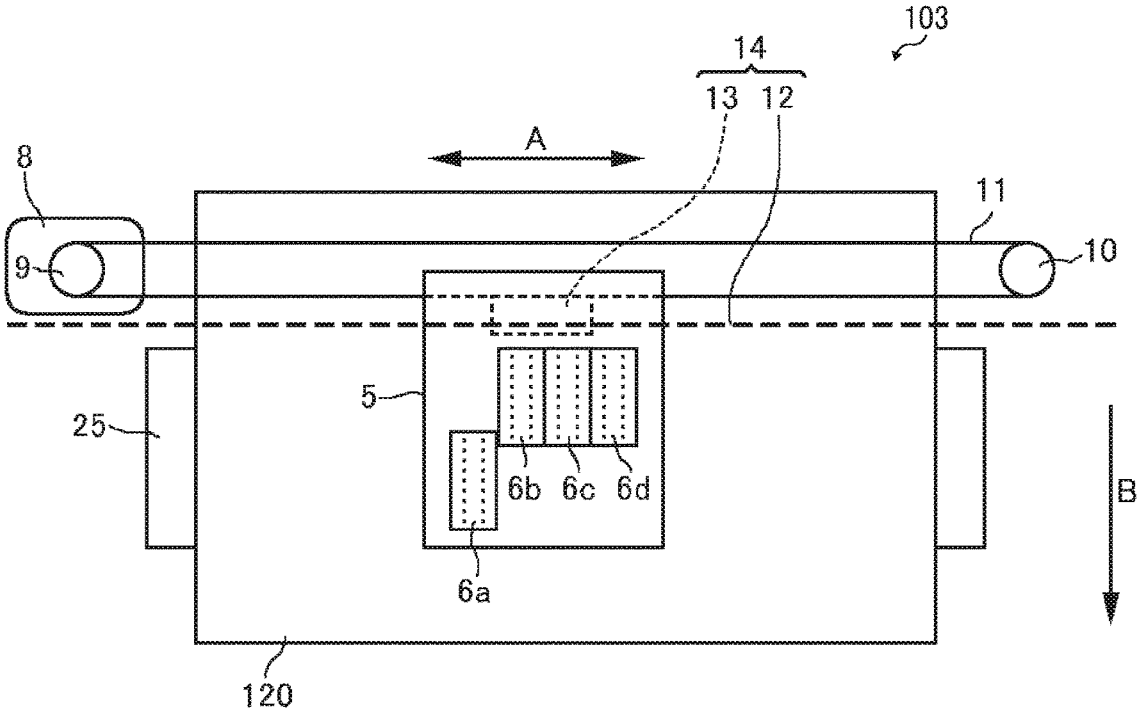
FIG. 3 is a plan view of a main section of an image forming device incorporated in the image forming apparatus depicted in FIG. 2.

Referring to FIGS. 1 to 3, a description is provided of one example of a construction of an image forming apparatus 1000 incorporating a roll holder 30.

FIG. 1 is an external perspective view of the image forming apparatus 1000 seen from a position obliquely upward from the image forming apparatus 1000. FIG. 2 is a cross-sectional side view of the image forming apparatus 1000. FIG. 3 is a plan view of a main section of an image forming device 103 of the image forming apparatus 1000.

As illustrated in FIG. 1, the image forming apparatus 1000 is a serial-type image forming apparatus that includes a body 101 and a sheet feeder 102 disposed below the body 101. The sheet feeder 102 may be separated from the body 101 and disposed below the body 101. As illustrated in FIG. 2, according to this embodiment, the sheet feeder 102 is combined with the body 101.

As illustrated in FIG. 2, the sheet feeder 102 and the image forming device 103 are disposed inside the body 101. The sheet feeder 102 draws a rolled sheet 120, serving as a rolled print medium or a rolled recording medium, out of a roll 112 and feeds the rolled sheet 120 to the image forming device 103. The image forming device 103 forms an image on the rolled sheet 120.

The image forming device 103 includes a guide rod 1, a guide stay 2, and a carriage 5. The guide rod 1 and the guide stay 2, serving as a guide, bridge both side plates. The guide rod 1 and the guide stay 2 support the carriage 5 such that the carriage 5 is movable in a carriage moving direction, that is, a main scanning direction A depicted in FIG. 1.

As illustrated in FIG. 3, a main scanning motor 8 serving as a driver is disposed at one end of the image forming device 103 in the main scanning direction A. The main scanning motor 8 moves the carriage 5 reciprocally. The main scanning motor 8 drives and rotates a driving pulley 9. A driven pulley 10 is disposed at another end of the image forming device 103 in the main scanning direction A. A timing belt 11 is looped over the driving pulley 9 and the driven pulley 10. A belt holder of the carriage 5 is secured to the timing belt 11. As the main scanning motor 8 drives and rotates the timing belt 11 through the driving pulley 9, the timing belt 11 moves the carriage 5 reciprocally in the main scanning direction A.

A description is provided of a configuration of recording heads 6*a*, 6*b*, 6*c*, and 6*d*. The carriage 5 mounts a plurality of recording heads, for example, the four recording heads 6*a*, 6*b*, 6*c*, and 6*d*. Each of the recording heads 6*a*, 6*b*, 6*c*, and 6*d* includes a liquid discharge head and a head tank that supplies liquid to the liquid discharge head. The liquid discharge head and the head tank are integrated into a single unit. The recording heads 6*a*, 6*b*, 6*c*, and 6*d* are mentioned below as recording heads 6 if the recording heads 6*a*, 6*b*, 6*c*, and 6*d* are not distinguished from each other.

The recording head 6*a* is shifted from the recording heads 6*b*, 6*c*, and 6*d* by a length of a single head (e.g., a combined length of a plurality of nozzles aligned in a row) in a sub-scanning direction B perpendicular to the main scanning direction A. The recording head 6 has nozzle rows, each of which includes a plurality of nozzles arrayed in a row in the sub-scanning direction B perpendicular to the main scanning direction A. The nozzles discharge liquid droplets downward.

Each of the recording heads 6*a*, 6*b*, 6*c*, and 6*d* has two nozzle rows. Each of the recording heads 6*a* and 6*b* discharges liquid droplets in an identical color, for example, black liquid droplets, from the two nozzle rows. The recording head 6*c* discharges cyan liquid droplets from one nozzle row. Another nozzle row of the recording head 6*c* is not used. The recording head 6*d* discharges yellow liquid droplets from one nozzle row and magenta liquid droplets from another nozzle row.

Accordingly, the recording heads 6*a* and 6*b* are used to form a monochrome image. As the recording heads 6*a* and 6*b* move once in the main scanning direction A, the recording heads 6*a* and 6*b* form an image having a combined length of a length of the recording head 6*a* and a length of the recording head 6*b* in the sub-scanning direction B. The recording heads 6*b*, 6*c*, and 6*d* are used to form a color image, for example. The recording heads 6*a*, 6*b*, 6*c*, and 6*d* may have configurations other than the above-described configuration. For example, a plurality of recording heads 6 may be aligned in the main scanning direction A.

An encoder sheet 12 is disposed along the carriage moving direction of the carriage 5, that is, the main scanning direction A. The carriage 5 mounts an encoder sensor 13 that reads the encoder sheet 12. The encoder sheet 12 and the encoder sensor 13 construct a linear encoder 14. The position and the speed of the carriage 5 are detected based on an output from the linear encoder 14.

The sheet feeder 102 depicted in FIG. 2 feeds the rolled sheet 120 to a recording region of a main scanning region in which the carriage 5 moves in the main scanning direction A. A conveyer 21 depicted in FIG. 2 conveys the rolled sheet 120 intermittently in a sheet conveyance direction, that is, the sub-scanning direction B perpendicular to the main scanning direction A in which the carriage 5 moves.

As illustrated in FIG. 1, an ink cartridge 60 serves as a main tank detachably attached to the body 101 so that the ink cartridge 60 is replaceable with new one. The ink cartridge 60 supplies ink in various colors to the head tanks of the recording heads 6 through supply tubes, respectively. A maintenance device 80 is disposed at one end of the body 101 in the main scanning direction A. The maintenance device 80 is disposed opposite one side of the carriage 5 and is disposed beside a conveyance guide 25. The maintenance device 80 maintains and recovers the recording heads 6.

As illustrated in FIG. 2, the conveyer 21 includes a conveyance roller 23 and a pressure roller 24. The conveyance roller 23 conveys the rolled sheet 120 serving as a rolled medium fed by the sheet feeder 102. The pressure roller 24 is disposed opposite the conveyance roller 23. Downstream from the conveyance roller 23 in the sheet conveyance direction are the conveyance guide 25 and a suction fan 26. The conveyance guide 25 includes a plurality of suction holes. The suction fan 26 serves as a suction device that performs suction from the suction holes of the conveyance guide 25.

Downstream from the conveyer 21 in the sheet conveyance direction is a cutter 27 that cuts the rolled sheet 120 bearing the image formed by the recording heads 6 into a sheet having a predetermined length.

The sheet feeder 102 includes the roll 112. The roll 112 includes a hollow tube 114 as an axis of the roll 112 and the rolled sheet 120. The rolled sheet 120 (e.g., rolled paper) serving as a long rolled medium is wound around the hollow tube 114 (e.g., a paper tube) serving as a core into a roll.

The roll 112 may be produced by securing or adhering an end (e.g., a terminal) of the rolled sheet 120 to the hollow tube 114 with an adhesive, for example. Alternatively, the roll 112 may be produced by not securing or adhering the end of the rolled sheet 120 to the hollow tube 114.

Figure 4:
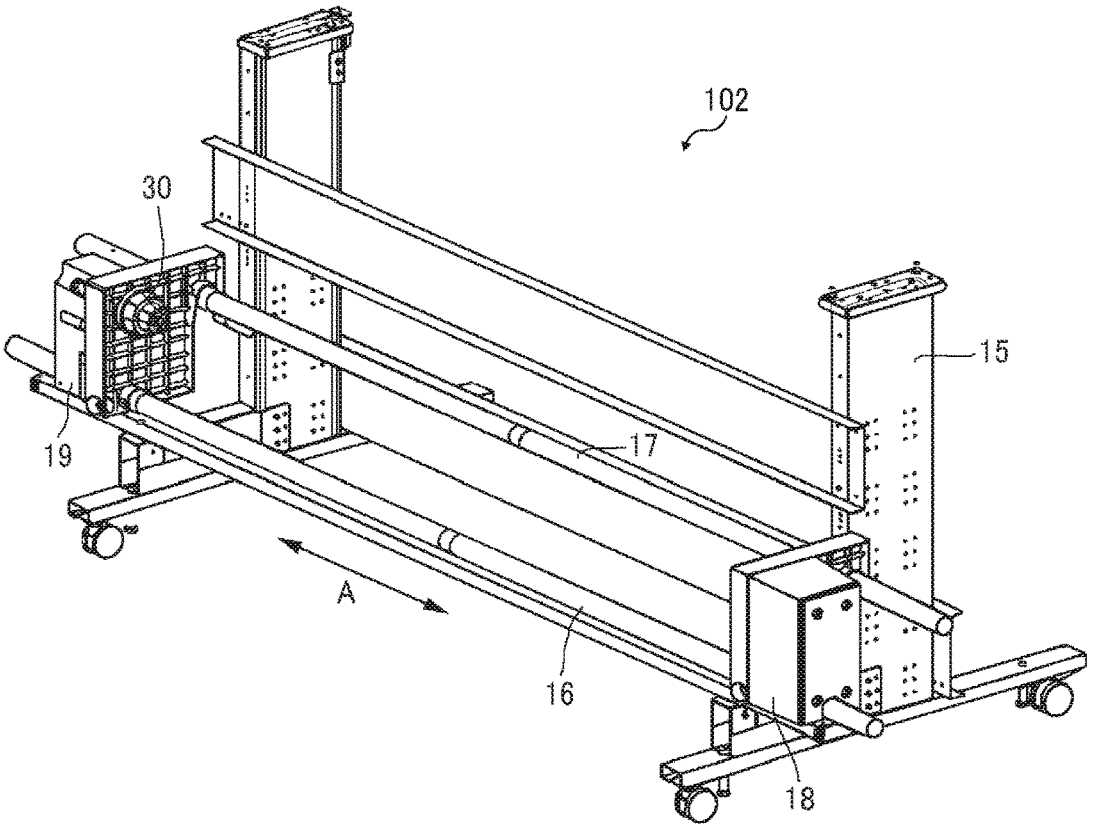
FIG. 4 is an external perspective view of a sheet feeder incorporated in the image forming apparatus depicted in FIG. 1.

FIG. 4 is an external perspective view of the sheet feeder 102 seen from a position obliquely upward from the sheet feeder 102. As illustrated in FIG. 4, the sheet feeder 102 includes a stand body 15, a first guide 16, a second guide 17, a first holding unit 18, and a second holding unit 19. The stand body 15 mounts the first guide 16 and the second guide 17 that are parallel to each other and extended in a longitudinal direction of the roll 112, that is, the main scanning direction A. The first guide 16 and the second guide 17 support the first holding unit 18 and the second holding unit 19 such that the first holding unit 18 and the second holding unit 19 are disposed opposite each other and movable in the main scanning direction A. Each of the first holding unit 18 and the second holding unit 19 includes the roll holder 30.

Each of the first holding unit 18 and the second holding unit 19 defines the first guide 16 as a main reference and the second guide 17 as a sub reference. The roll holder 30 of each of the first holding unit 18 and the second holding unit 19 is disposed immediately above the first guide 16. The first holding unit 18 includes a driver that drives and rotates the roll holder 30. Conversely, the second holding unit 19 does not include a driver. Each of the first holding unit 18 and the second holding unit 19 holds the roll 112 depicted in FIG. 2 as the roll holder 30 is fitted into the hollow tube 114 of the roll 112.

As illustrated in FIG. 2, the body 101 accommodates a guide 130 and a conveyance roller pair 131. The guide 130 guides the rolled sheet 120 drawn out of the roll 112 of the sheet feeder 102. The conveyance roller pair 131 bends or curves the rolled sheet 120 and feeds the rolled sheet 120 upward.

As the conveyance roller pair 131 is driven and rotated, the conveyance roller pair 131 conveys the rolled sheet 120 drawn out of the roll 112 while the rolled sheet 120 is stretched taut between the roll 112 and the conveyance roller pair 131. The rolled sheet 120 is sent to a nip formed between the conveyance roller 23 and the pressure roller 24 of the conveyer 21 through the conveyance roller pair 131.

With the image forming apparatus 1000 having the construction described above, in order to form an image on the rolled sheet 120, while the conveyer 21 conveys the rolled sheet 120 sent from the sheet feeder 102 intermittently, the carriage 5 moves in the main scanning direction A. The recording heads 6 are driven to discharge liquid droplets according to image data (e.g., print data), forming the image on the rolled sheet 120. The cutter 27 cuts the rolled sheet 120 bearing the image to have the predetermined length. A sheet ejection guide disposed in front of the body 101 guides and ejects the rolled sheet 120 into a bucket that stores the rolled sheet 120.

The above describes the construction of the image forming apparatus 1000 incorporating the roll holder 30. Alternatively, the construction described above may be applied to other apparatuses. For example, the construction described above may be applied to a liquid discharge apparatus incorporating the roll holder 30.

A description is provided of a construction of a first comparative roll holder.

The first comparative roll holder includes a plurality of enlarging abutments. One lateral end of each of the enlarging abutments is supported by a support. Another lateral end of each of the enlarging abutments contacts an inner circumferential face of a hollow tube serving as an axis of a roll (e.g., a rolled medium). The enlarging abutments enlarge in a radial direction of the roll according to the inner diameter of the hollow tube of the roll. Since the enlarging abutments enlarge in the radial direction of the roll, the first comparative roll holder is compatible with rolls having various inner diameters of hollow tubes.

A description is provided of a construction of a second comparative roll holder.

The second comparative roll holder includes a holder that holds a roll and a plurality of supports. If the roll includes a core tube having a great diameter, the plurality of supports contacts an outer circumferential face of a core shaft of the holder and an inner circumferential face of the core tube of the roll. Conversely, if the roll includes a core tube having a small diameter, the plurality of supports moves and a lateral end of the core tube of the roll contacts the supports to restrict a retracting position of the supports. Accordingly, motion of the supports is restricted without a lock.

With the first comparative roll holder, the enlarging abutments enlarge about the axis of the roll. Accordingly, the enlarging abutments that enlarge may have a reduced holding force to hold the roll according to the diameter of the roll, failing to hold the roll against rotation of the roll in a circumferential direction thereof.

With the second comparative roll holder, the plurality of supports does not move simultaneously. Accordingly, the roll may be attached to the holder while one or more of the supports does not move. Consequently, the roll may be attached to the second comparative roll holder while the holder does not hold the roll precisely.

A detailed description is provided of a construction of the roll holder 30.

A term "inner diameter" denotes an inner diameter of the hollow tube 114 of the roll 112. The hollow tube 114 includes a tube such as the paper tube. Alternatively, the hollow tube 114 may not include the tube or the core. In this case also, the hollow tube 114 serves as a hollow tube as long as the hollow tube 114 has a hollow.

Figure 5:
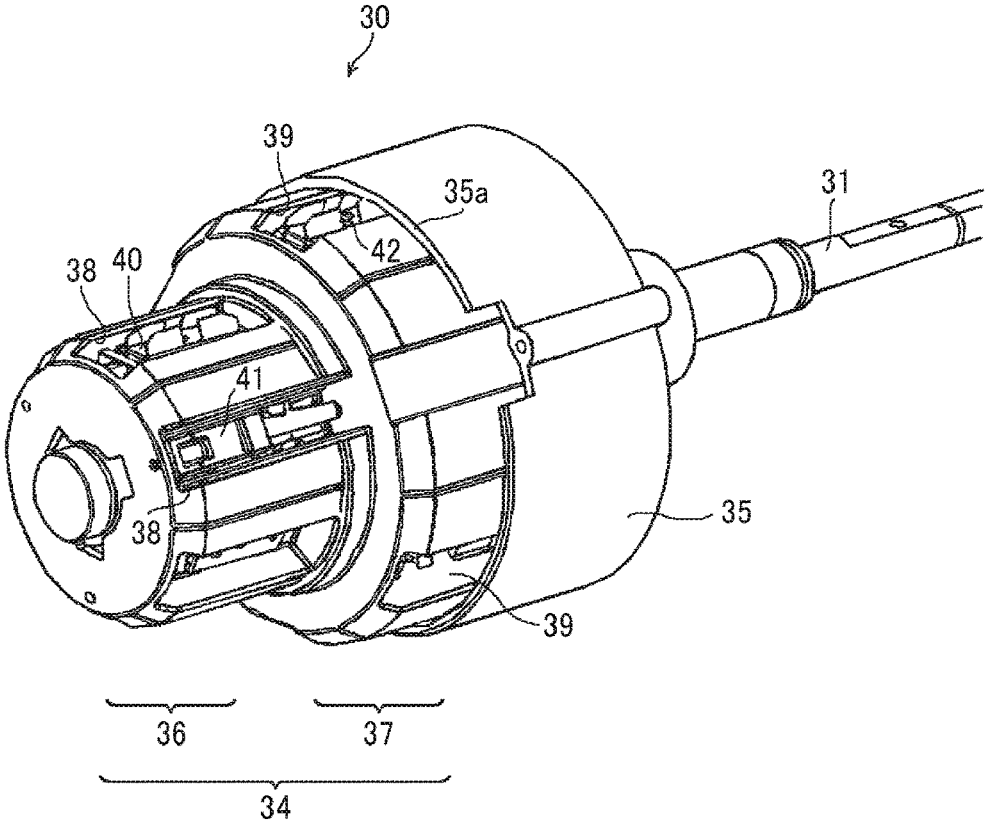
FIG. 5 is an external perspective view of a roll holder incorporated in the sheet feeder depicted in FIG. 4.

FIG. 5 is an external perspective view of the roll holder 30 according to an embodiment seen from a position obliquely upward from the roll holder 30. As illustrated in FIG. 5, the roll holder 30 includes a support shaft 31, a holder 34, and a cam assembly 35. The support shaft 31 is held by the first holding unit 18 depicted in FIG. 4 and coupled to the driver. Each of the holder 34 and the cam assembly 35 is movably supported by the support shaft 31. The holder 34 includes a 2-inch holding portion 36 and a 3-inch holding portion 37. The 2-inch holding portion 36 is fitted into the hollow tube 114 of the roll 112 as a 2-inch roll. The 3-inch holding portion 37 is fitted into the hollow tube 114 of the roll 112 as a 3-inch roll. The 2-inch holding portion 36 is combined with the 3-inch holding portion 37 on the common support shaft 31.

The 2-inch roll is one example of a first roll having a first inner diameter. The 3-inch roll is one example of a second roll having a second inner diameter. The first inner diameter is smaller than the second inner diameter. The 2-inch holding portion 36 is one example of a first roll holding portion (e.g., a first inner diameter holding portion) that corresponds to the first inner diameter. The 3-inch holding portion 37 is one example of a second roll holding portion (e.g., a second inner diameter holding portion) that corresponds to the second inner diameter.

The 2-inch holding portion 36 includes a plurality of slots 38, a 2-inch presser 40, and a wedge 41. The 2-inch presser 40 and the wedge 41 are disposed in the plurality of slots 38 arranged along a circumference of the 2-inch holding portion 36. The 3-inch holding portion 37 includes a plurality of slots 39 and a 3-inch presser 42. The 3-inch presser 42 is disposed in the plurality of slots 39 arranged along a circumference of the 3-inch holding portion 37. The 2-inch presser 40 contacts an inner circumferential face of the hollow tube 114 of the roll 112 as the 2-inch roll so that the 2-inch presser 40 presses against and holds the roll 112. The 3-inch presser 42 contacts the inner circumferential face of the hollow tube 114 of the roll 112 as the 3-inch roll so that the 3-inch presser 42 presses against and holds the roll 112. The wedge 41 restricts and releases motion of the 2-inch holding portion 36 of the holder 34 with respect to the support shaft 31.

The 2-inch presser 40 is one example of a first presser that corresponds to the first inner diameter. The 3-inch presser 42 is one example of a second presser that corresponds to the second inner diameter.

The cam assembly 35 includes a 3-inch abutment 35*a*. As a lateral end of the roll 112 as the 3-inch roll comes into contact with the 3-inch abutment 35*a* of the cam assembly 35, the cam assembly 35 moves in an axial direction of the support shaft 31. The cam assembly 35 further includes a plurality of cams that lifts the 2-inch presser 40 and the 3-inch presser 42 and brings the 2-inch presser 40 and the 3-inch presser 42 into contact with the inner circumferential face of the hollow tube 114 of the roll 112.

Figure 6:
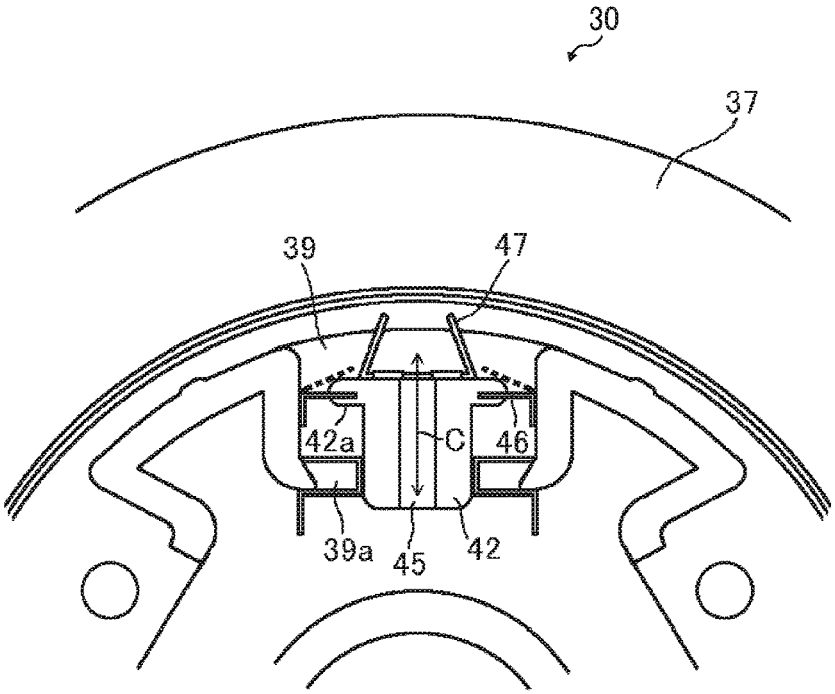
FIG. 6 is a cross-sectional front view of a 3-inch presser incorporated in the roll holder depicted in FIG. 5 and a periphery of the 3-inch presser.

FIG. 6 is a cross-sectional front view of the 3-inch presser 42 of the roll holder 30 and a periphery of the 3-inch presser 42. As illustrated in FIG. 6, the 3-inch holding portion 37 further includes a guide 45 that holds the 3-inch presser 42 such that the 3-inch presser 42 is movable vertically in FIG. 6 in a direction C. An elastic cover 46 is disposed on an edge of the slot 39 of the 3-inch holding portion 37. As the 3-inch presser 42 moves upward for a predetermined amount or greater, the elastic cover 46 deforms as illustrated in a dotted line to bias the 3-inch presser 42 downward. Conversely, since the 3-inch presser 42 includes an abutment portion 42*a* that comes into contact with a receiver 39*a* of the slot 39, the receiver 39*a* restricts downward motion of the 3-inch presser 42 in the direction C.

With the above-described construction of the roll holder 30, the 3-inch presser 42 is movable about the support shaft 31 in a radial direction thereof. An elastic presser cover 47 is disposed on an upper face of the 3-inch presser 42, which contacts the inner circumferential face of the hollow tube 114 of the roll 112. Even if the inner diameter of the roll 112 held by the roll holder 30 varies, the elastic presser cover 47 deforms elastically to absorb variation of the inner diameter of the roll 112. The elastic presser cover 47 may also be disposed on an upper face of the 2-inch presser 40, which contacts the inner circumferential face of the hollow tube 114 of the roll 112.

The above describes a construction of the 3-inch presser 42 and the periphery thereof with reference to FIG. 6. Since the 2-inch presser 40 and a periphery thereof have a construction similar to the construction of the 3-inch presser 42 and the periphery thereof, a description of the construction of the 2-inch presser 40 and the periphery thereof is omitted.

Figure 7:
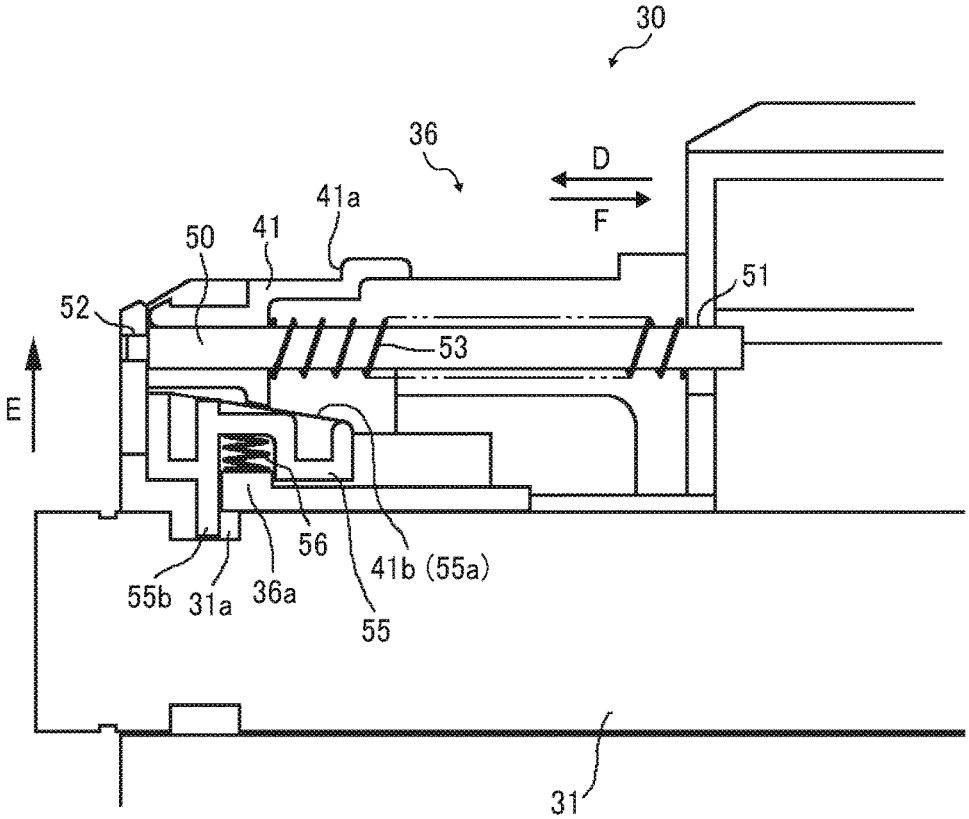
FIG. 7 is a cross-sectional side view of the roll holder depicted in FIG. 5, illustrating a wedge, a lock, and a periphery thereof.
Figure 8:
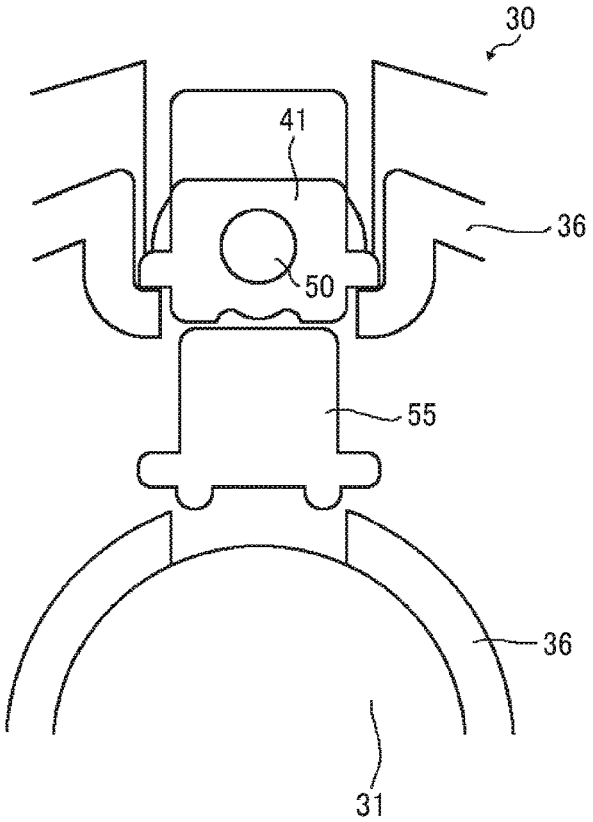
FIG. 8 is a cross-sectional front view of the roll holder depicted in FIG. 7.

FIG. 7 is a cross-sectional side view of the roll holder 30 according to an embodiment, illustrating the wedge 41, a lock 55, and a periphery thereof. FIG. 8 is a cross-sectional front view of the roll holder 30 according to an embodiment, illustrating the wedge 41, the lock 55, and the periphery thereof. As illustrated in FIG. 7, the 2-inch holding portion 36 further includes guide support holes 51 and 52 that support a guide 50 such that an axial direction of the guide 50 is parallel to the axial direction of the support shaft 31. The guide 50 supports the wedge 41 such that the wedge 41 is movable in the axial direction of the support shaft 31. A spring 53 serving as a first resilient member anchored to the guide 50 biases the wedge 41 in a direction D.

The wedge 41 includes an abutment 41*a* disposed at an upper part of the wedge 41. As the roll 112 as the 2-inch roll is inserted into the roll holder 30, the roll 112 comes into contact with the abutment 41*a*. The wedge 41 further includes a taper 41*b* disposed at a lower part of the wedge 41. The taper 41*b* contacts a taper 55*a* of the lock 55 disposed below the wedge 41. The lock 55 is disposed opposite and in contact with the wedge 41. Thus, the wedge 41 and the lock 55 contacting the wedge 41 define a slope or a contact face that is inclined.

The lock 55 restricts motion of the 2-inch holding portion 36 of the holder 34 with respect to the support shaft 31. The lock 55 includes an engagement 55*b*. The support shaft 31 includes a lateral end groove 31*a*. The engagement 55*b* contacts the lateral end groove 31*a* to restrict motion of the 2-inch holding portion 36 of the holder 34 in the axial direction of the support shaft 31.

A spring 56 serving as a second resilient member anchored to a boss 36*a* of the 2-inch holding portion 36 biases the lock 55 upward in FIG. 7 in a release direction E. Accordingly, as the wedge 41 moves rightward in an insertion direction F in which the roll 112 is inserted into the roll holder 30, which is opposite the direction D, the lock 55 moves upward in the release direction E, releasing locking or restriction by the lock 55. For example, the engagement 55*b* separates from the lateral end groove 31*a*.

With the above-described construction of the roll holder 30, as the lateral end of the roll 112 as the 2-inch roll comes into contact with the abutment 41*a* of the wedge 41, the wedge 41 moves rightward in the insertion direction F opposite the direction D, releasing locking by the lock 55. Thus, the 2-inch holding portion 36 of the holder 34 moves rightward in the insertion direction F.

While the roll holder 30 does not hold the roll 112, the resilient force of the spring 53 directed in the direction D, the resilient force of the spring 56 directed in the release direction E, the inclination angle of the tapers 41*b* and 55*a*, and the friction coefficient of the tapers 41*b* and 55*a* define a relation that places the engagement 55*b* of the lock 55 inside the lateral end groove 31*a* and restricts motion of the 2-inch holding portion 36 of the holder 34 in the axial direction of the support shaft 31 as illustrated in FIG. 7.

Figure 9:
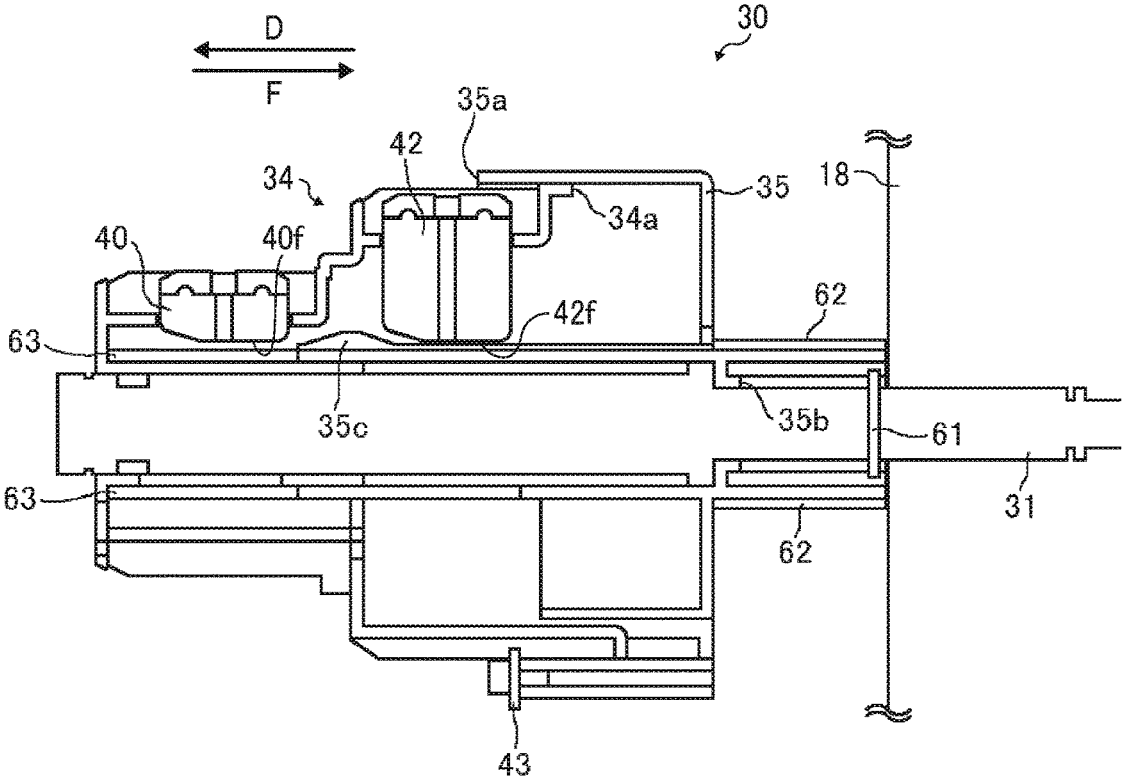
FIG. 9 is a cross-sectional side view of the roll holder depicted in FIG. 5 which does not hold a roll.

FIG. 9 is a cross-sectional side view of the roll holder 30 according to an embodiment, which does not hold the roll 112. FIG. 9 illustrates the roll holder 30 mounted on the first holding unit 18. The roll holder 30 is also mounted on the second holding unit 19 as illustrated in FIG. 4. As illustrated in FIG. 9, the support shaft 31 supports the cam assembly 35, like the holder 34, such that the cam assembly 35 is movable in the axial direction of the support shaft 31. The cam assembly 35 includes stoppers 43 and 35*b*. As the holder 34 moves rightward in FIG. 9 in the insertion direction F opposite the direction D, the holder 34 comes into contact with the stopper 43 that stops the holder 34. The stopper 35*b* comes into contact with a retaining ring 61 that is mounted on the support shaft 31 and stops the cam assembly 35. As described above with reference to FIG. 5, the cam assembly 35 includes the 3-inch abutment 35*a* with which the roll 112 as the 3-inch roll comes into contact as the roll 112 is attached to the roll holder 30.

As illustrated in FIG. 9, the cam assembly 35 further includes a plurality of cams 35*c* disposed on a circumference of the cam assembly 35. As the cam assembly 35 or the holder 34 moves, the cams 35*c* come into contact with a lower face 40*f* or 42*f*, that is, a support shaft side face, of the 2-inch presser 40 or the 3-inch presser 42, thus lifting the 2-inch presser 40 or the 3-inch presser 42.

A spring 62 is interposed between the cam assembly 35 and the first holding unit 18. The spring 62 biases the cam assembly 35 in the direction D in which the cam assembly 35 separates from the first holding unit 18. Additionally, a spring 63 is interposed between the 2-inch holding portion 36 of the holder 34 and the cam assembly 35. The spring 63 biases the cam assembly 35 in the insertion direction F, which is opposite the direction D, in which the cam assembly 35 moves toward the first holding unit 18.

The holder 34 includes an abutment 34*a* that contacts and moves with the cam assembly 35.

A description is provided of an operation of the roll holder 30 to hold the roll 112.

Figure 10:
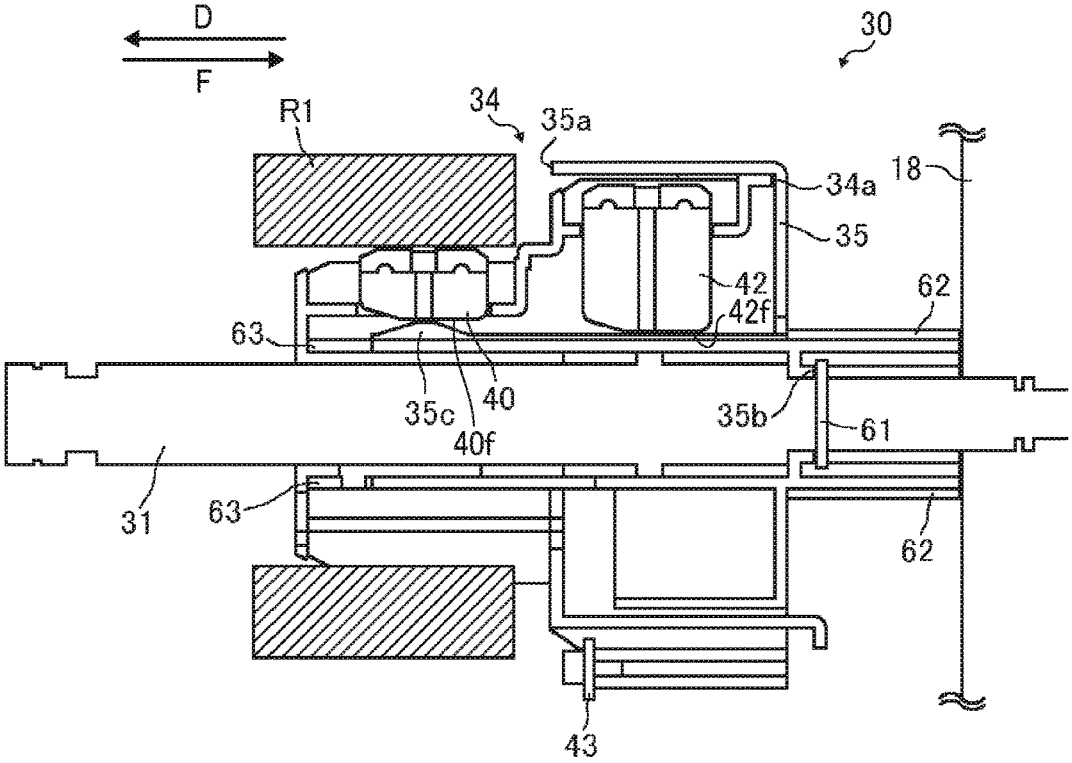
FIG. 10 is a cross-sectional side view of the roll holder depicted in FIG. 5 which holds a 2-inch roll.

FIG. 10 is a cross-sectional side view of the roll holder 30 according to an embodiment, which holds the roll 112 as the 2-inch roll. In FIG. 10, the identical reference numerals are assigned to the components also illustrated in FIG. 9 and detailed descriptions of the components are omitted.

As a 2-inch roll R1 is attached to the roll holder 30, the 2-inch roll R1 comes into contact with the abutment 41*a* of the wedge 41 depicted in FIG. 7, moving the wedge 41 and releasing locking by the lock 55 with the engagement 55*b* of the lock 55 and the lateral end groove 31*a* of the support shaft 31. The holder 34 that is unlocked is moved rightward in FIG. 10 in the insertion direction F opposite the direction D by an external force that puts the 2-inch roll R1 on the roll holder 30. Accordingly, the abutment 34*a* of the holder 34 comes into contact with the cam assembly 35. The holder 34 and the cam assembly 35 move together. As the stopper 35*b* of the cam assembly 35 comes into contact with the retaining ring 61 mounted on the support shaft 31, the retaining ring 61 stops the cam assembly 35.

Simultaneously, the cams 35*c* of the cam assembly 35 come into contact with the lower face 40*f* of the 2-inch presser 40, lifting the 2-inch presser 40 to a pressing position where the 2-inch presser 40 presses against the 2-inch roll R1. Accordingly, the 2-inch presser 40 of the 2-inch holding portion 36 of the roll holder 30 holds the 2-inch roll R1.

Figure 11:
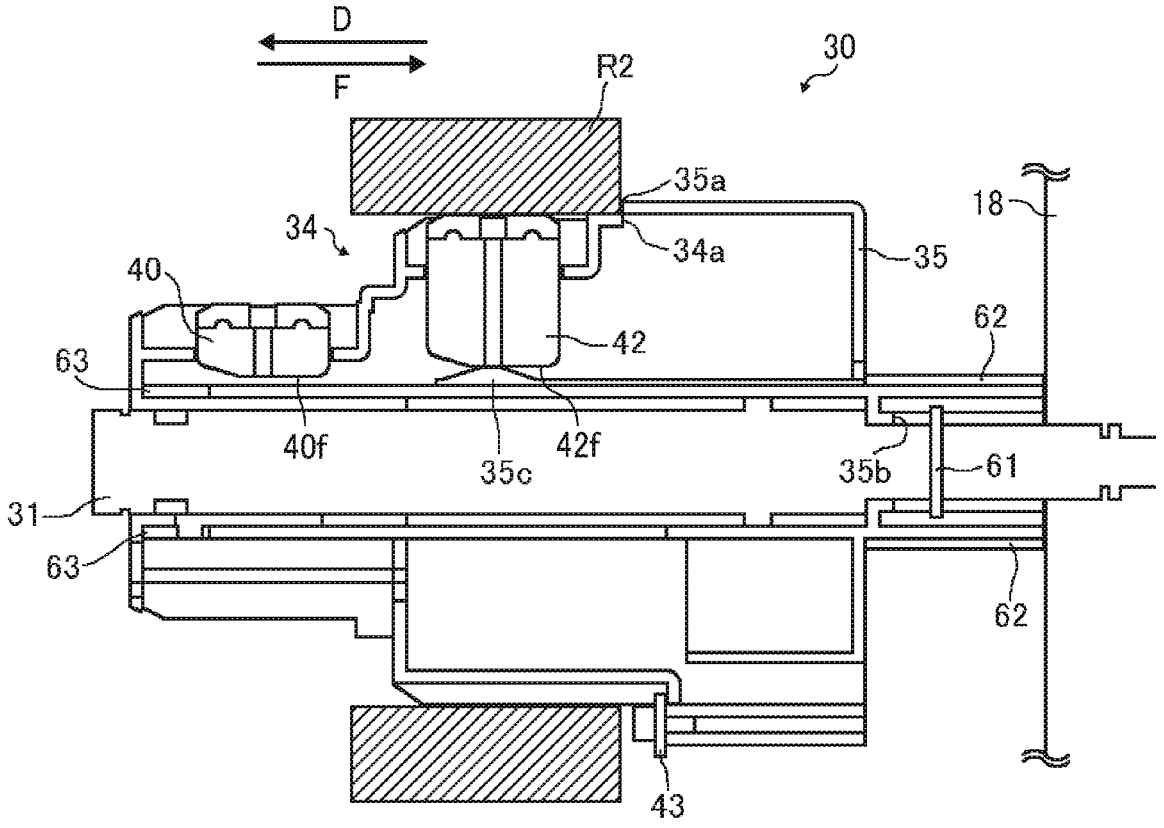
FIG. 11 is a cross-sectional side view of the roll holder depicted in FIG. 5 which holds a 3-inch roll.

FIG. 11 is a cross-sectional side view of the roll holder 30 according to an embodiment, which holds the roll 112 as the 3-inch roll. In FIG. 11, the identical reference numerals are assigned to the components also illustrated in FIG. 9 and detailed descriptions of the components are omitted.

As illustrated in FIG. 11, as a 3-inch roll R2 is attached to the roll holder 30, the 3-inch roll R2 comes into contact with the 3-inch abutment 35*a* of the cam assembly 35, moving the cam assembly 35 rightward in the insertion direction F opposite the direction D. Conversely, the wedge 41 depicted in FIG. 7 does not move, thus restricting motion of the holder 34. Hence, as the stopper 43 of the cam assembly 35 comes into contact with the holder 34, the cam assembly 35 stops.

Simultaneously, the cams 35*c* of the cam assembly 35 come into contact with the lower face 42*f* of the 3-inch presser 42, lifting the 3-inch presser 42 to a pressing position where the 3-inch presser 42 presses against the 3-inch roll R2. Accordingly, the 3-inch presser 42 of the 3-inch holding portion 37 of the roll holder 30 holds the 3-inch roll R2.

As described above, as the roll 112 is put on the roll holder 30, the holder 34 and the cam assembly 35 move relatively to each other. Accordingly, the cams 35*c* of the cam assembly 35 press the 2-inch presser 40 or the 3-inch presser 42 against an inner circumferential face of the roll 112. Since the 2-inch presser 40 serving as a first presser or the 3-inch presser 42 serving as a second presser presses against the roll 112 in accordance with motion of the roll 112 being put on the roll holder 30, the roll holder 30 holds the rolls 112 having various inner diameters readily.

Since the external force that puts the 2-inch roll R1 or the 3-inch roll R2 on the roll holder 30 changes the position of the cam assembly 35, the lateral end of the 2-inch roll R1 and the lateral end of the 3-inch roll R2 are placed on an identical hypothetical plane. Accordingly, when the roll holder 30 holds the 2-inch roll R1, the lateral end of the 2-inch roll R1 does not strike and damage the 3-inch abutment 35*a* of the cam assembly 35 as illustrated in FIG. 10.

A description is provided of definition of terms used in the present disclosure.

The term "liquid discharge apparatus" denotes an apparatus including a liquid discharge head or a liquid discharge device (e.g., a liquid discharge unit) to discharge liquid by driving the liquid discharge head. The liquid discharge apparatus includes an apparatus capable of discharging liquid to a material onto which liquid adheres and an apparatus to discharge liquid toward gas or into liquid.

The liquid discharge apparatus includes devices to feed, convey, and eject the material onto which liquid adheres. The liquid discharge apparatus further includes a pretreatment device to apply treatment liquid to the material before liquid is discharged onto the material and a post-treatment device to apply treatment liquid to the material after liquid is discharged onto the material.

The liquid discharge apparatus is, for example, an image forming apparatus to form an image on a sheet by discharging ink or a three-dimensional fabricating apparatus (e.g., a solid-object fabricating apparatus) to discharge fabrication liquid to a powder layer in which powder is formed in a layer, so as to form a three-dimensional fabrication object (e.g., a solid fabrication object).

The liquid discharge apparatus is not limited to an apparatus to discharge liquid to visualize meaningful images such as letters and figures. For example, the liquid discharge apparatus includes an apparatus to form meaningless images, such as meaningless patterns, or fabricate three-dimensional images.

The above-described term "material onto which liquid adheres" denotes, for example, a material or a medium onto which liquid is adhered at least temporarily, a material or a medium onto which liquid is adhered and fixed, or a material or a medium onto which liquid is adhered and into which the liquid permeates. Examples of the "material onto which liquid adheres" include recording media such as a paper sheet, recording paper, and a recording sheet of paper, film, and cloth, electronic components such as an electronic substrate and a piezoelectric element, and media such as a powder layer, an organ model, and a testing cell. The "material onto which liquid adheres" includes any material onto which liquid adheres unless particularly limited.

Examples of the material onto which liquid adheres include any materials onto which liquid adheres even temporarily, such as paper, thread, fiber, fabric, leather, metal, plastic, glass, wood, ceramics, building materials (e.g., wallpaper and a flooring material), and a cloth textile.

Examples of the liquid are ink, treatment liquid, a deoxyribonucleic acid (DNA) sample, a resist, a pattern material, a binder, fabrication liquid, and a solution and dispersion liquid including amino acid, protein, or calcium.

The liquid discharge apparatus includes an apparatus to relatively move the liquid discharge head and the material onto which liquid adheres. However, the liquid discharge apparatus is not limited to such apparatus. For example, the liquid discharge apparatus is a serial head apparatus that moves the liquid discharge head, a line head apparatus that does not move the liquid discharge head, or the like.

Examples of the liquid discharge apparatus further include a treatment liquid coating apparatus to discharge treatment liquid onto a sheet to coat a surface of the sheet with the treatment liquid to reform the surface of the sheet and an injection granulation apparatus in which composition liquid including raw materials dispersed in a solution is injected through nozzles to granulate fine particles of the raw materials.

The liquid discharge device (e.g., the liquid discharge unit) is an integrated unit including the liquid discharge head and one or more functional parts and devices and is an assembly of parts relating to liquid discharge. For example, the liquid discharge device (e.g., the liquid discharge unit) includes a combination of the liquid discharge head with at least one of a head tank, a carriage, a supply device, a maintenance device, and a main scanning moving device.

Examples of the integrated unit include a combination in which the liquid discharge head and one or more functional parts and devices are secured to each other through, e.g., fastening, bonding, or engaging, and a combination in which one of the liquid discharge head and the functional parts and devices is movably held by another. The liquid discharge head may be detachably attached to the functional parts and devices each other.

For example, the liquid discharge head and the head tank are integrated as the liquid discharge device. Alternatively, the liquid discharge head may be coupled with the head tank through a tube or the like to integrally form the liquid discharge device. A unit including a filter may be added at a position between the head tank and the liquid discharge head of the liquid discharge device.

As another example, the liquid discharge device is an integrated unit in which the liquid discharge head and the carriage are integrated as a single unit.

As yet another example, the liquid discharge device is an integrated unit in which the liquid discharge head, which is movably held by a guide that forms a part of the main scanning moving unit, and the main scanning moving unit are integrated as a single unit. As yet another example, the liquid discharge device is an integrated unit in which the liquid discharge head, the carriage, and the main scanning moving unit are integrated as a single unit.

As yet another example, the liquid discharge device is an integrated unit in which a cap that forms a part of the maintenance device is secured to the carriage mounting the liquid discharge head so that the liquid discharge head, the carriage, and the maintenance device are integrated as a single unit.

As yet another example, the liquid discharge device is an integrated unit in which a tube of the supply device is connected to the head tank or the liquid discharge head attached with a channel so that the liquid discharge head and the supply device are integrated as a single unit.

The main scanning moving device may be a guide. The supply device may be a tube or a loading unit.

A pressure generator used in the liquid discharge head is not limited to a particular-type pressure generator. The pressure generator is not limited to a piezoelectric actuator or a layered-type piezoelectric element described in the above-described embodiments and may be a thermal actuator that employs a thermoelectric conversion element such as a thermal resistor, an electrostatic actuator including a diaphragm plate and opposed electrodes, or the like.

The terms "image formation", "recording", "text printing", "image printing", "printing", "fabricating", and the like used herein may be used synonymously with each other.

According to the embodiments described above, the image forming apparatus 1000 incorporating the roll holder 30 forms an image on the rolled sheet 120 with liquid (e.g., ink). Alternatively, the image forming apparatus 1000 may form an image on the rolled sheet 120 with solid (e.g., toner).

A description is provided of advantages of a roll holder (e.g., the roll holder 30).

As illustrated in FIGS. 10 and 11, the roll holder is inserted with a hollow tube of one of a first roll (e.g., the 2-inch roll R1) having a first inner diameter and a second roll (e.g., the 3-inch roll R2) having a second inner diameter greater than the first inner diameter. The roll holder holds the first roll and the second roll. The roll holder includes a support shaft (e.g., the support shaft 31), a holder (e.g., the holder 34), and a cam assembly (e.g., the cam assembly 35).

The holder is supported by the support shaft and movable in an axial direction of the support shaft. The cam assembly is supported by the support shaft and movable in the axial direction of the support shaft. The cam assembly includes an abutment (e.g., the 3-inch abutment 35*a*) to contact a lateral end of the second roll in the axial direction of the support shaft.

As illustrated in FIG. 5, the holder includes a first roll holding portion (e.g., the 2-inch holding portion 36) that holds the first roll and a second roll holding portion (e.g., the 3-inch holding portion 37) that holds the second roll. The first roll holding portion includes a wedge (e.g., the wedge 41) and a first presser (e.g., the 2-inch presser 40). The wedge contacts a lateral end of the first roll in the axial direction of the support shaft. The first presser is movable about the support shaft in a radial direction thereof. The second roll holding portion includes a second presser (e.g., the 3-inch presser 42) that is movable about the support shaft in the radial direction thereof.

As illustrated in FIGS. 10 and 11, the cam assembly includes a cam (e.g., the cam 35*c*) to contact a support shaft side face (e.g., the lower face 40*f* or 420 of one of the first presser and the second presser to move the one of the first presser and the second presser in the radial direction of the support shaft. As the first roll is put on the roll holder, the first roll comes into contact with the wedge of the holder. As the second roll is put on the roll holder, the second roll comes into contact with the abutment of the cam assembly. Thus, the holder and the cam assembly move relative to each other. The cam moves to the support shaft side face of the one of the first presser and the second presser. Accordingly, the one of the first presser and the second presser presses against and holds an inner circumferential face of the hollow tube of corresponding one of the first roll and the second roll.

As illustrated in FIG. 10, the first presser of the first roll holding portion holds the first roll. As illustrated in FIG. 11, the second presser of the second roll holding portion holds the second roll. Accordingly, as the first roll or the second roll is put on the roll holder, the first presser or the second presser moves and presses against the inner circumferential face of the hollow tube of the first roll or the second roll. Consequently, the roll holder readily holds the first roll and the second roll that have different inner diameters, respectively.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A roll holder for being inserted with a hollow tube of one of a first roll having a first inner diameter and a second roll having a second inner diameter greater than the first inner diameter, the roll holder for holding the one of the first roll and the second roll and comprising:

a support shaft;

a holder being supported by the support shaft and movable in an axial direction of the support shaft, the holder including:

a first roll holding portion to hold the first roll, the first roll holding portion including:

a wedge to contact a lateral end of the first roll in the axial direction of the support shaft; and a first presser being movable about the support shaft in a radial direction of the support shaft; and a second roll holding portion to hold the second roll, the second roll holding portion including:

a second presser being movable about the support shaft in the radial direction of the support shaft; and a cam assembly being supported by the support shaft and movable in the axial direction of the support shaft, the cam assembly including:

an abutment to contact a lateral end of the second roll in the axial direction of the support shaft; and a cam to move to one of the first presser and the second presser when the one of the first roll and the second roll contacts corresponding one of the wedge and the abutment, the cam to press against the one of the first presser and the second presser in the radial direction of the support shaft to cause the one of the first presser and the second presser to press against and hold an inner circumferential face of a hollow tube of the one of the first roll and the second roll.

2. The roll holder according to claim 1, wherein the cam contacts a support shaft side face of the one of the first presser and the second presser, the support shaft side face disposed opposite the support shaft.

3. The roll holder according to claim 1, wherein the lateral end of the first roll and the lateral end of the second roll are placed on an identical hypothetical plane when the holder holds the first roll and the second roll.

4. The roll holder according to claim 1, further comprising an elastic presser cover disposed on the first presser and the second presser, the elastic presser cover to contact the inner circumferential face of the hollow tube of the first roll and the second roll.

5. The roll holder according to claim 1, wherein the first roll holding portion further includes a lock being disposed opposite and in contact with the wedge, the lock to restrict motion of the first roll holding portion with respect to the support shaft.

6. The roll holder according to claim 5, wherein the first roll holding portion further includes:

a first resilient member to bias the wedge in a direction opposite an insertion direction in which the first roll is inserted into the first roll holding portion; and a second resilient member to bias the lock in a release direction that releases restriction by the lock.

7. The roll holder according to claim 6, wherein each of the first resilient member and the second resilient member includes a spring.

8. The roll holder according to claim 6, wherein the wedge includes a first taper and the lock includes a second taper contacting the first taper.

9. The roll holder according to claim 8, wherein as the first roll contacts and moves the wedge in the insertion direction, the second resilient member moves the lock in the release direction.

10. The roll holder according to claim 1, wherein the cam assembly further includes:

a first stopper to stop the cam assembly; and a second stopper to stop the holder.

11. The roll holder according to claim 10, further comprising a retaining ring mounted on the support shaft, wherein the first stopper comes into contact with the retaining ring.

12. The roll holder according to claim 10, wherein the second presser includes an abutment portion to contact the cam assembly.

13. An image forming apparatus comprising:

a roll holder for being inserted with a hollow tube of one of a first roll having a first inner diameter and a second roll having a second inner diameter greater than the first inner diameter; and an image forming device to form an image on a sheet drawn out of the first roll and the second roll, the roll holder for holding the one of the first roll and the second roll and comprising:

a support shaft;

a holder being supported by the support shaft and movable in an axial direction of the support shaft, the holder including:

a first roll holding portion to hold the first roll, the first roll holding portion including:

a wedge to contact a lateral end of the first roll in the axial direction of the support shaft; and a first presser being movable about the support shaft in a radial direction of the support shaft; and a second roll holding portion to hold the second roll, the second roll holding portion including:

a second presser being movable about the support shaft in the radial direction of the support shaft; and a cam assembly being supported by the support shaft and movable in the axial direction of the support shaft, the cam assembly including:

an abutment to contact a lateral end of the second roll in the axial direction of the support shaft; and a cam to move to one of the first presser and the second presser when the one of the first roll and the second roll contacts corresponding one of the wedge and the abutment, the cam to press against the one of the first presser and the second presser in the radial direction of the support shaft to cause the one of the first presser and the second presser to press against and hold an inner circumferential face of a hollow tube of the one of the first roll and the second roll.

14. A liquid discharge apparatus comprising:

a roll holder for being inserted with a hollow tube of one of a first roll having a first inner diameter and a second roll having a second inner diameter greater than the first inner diameter; and a recording head to discharge liquid onto a sheet drawn out of the first roll and the second roll, the roll holder for holding the one of the first roll and the second roll and comprising:

a support shaft;

a holder being supported by the support shaft and movable in an axial direction of the support shaft, the holder including:

a first roll holding portion to hold the first roll, the first roll holding portion including:

a wedge to contact a lateral end of the first roll in the axial direction of the support shaft; and a first presser being movable about the support shaft in a radial direction of the support shaft; and a second roll holding portion to hold the second roll, the second roll holding portion including:

a second presser being movable about the support shaft in the radial direction of the support shaft; and a cam assembly being supported by the support shaft and movable in the axial direction of the support shaft, the cam assembly including:

an abutment to contact a lateral end of the second roll in the axial direction of the support shaft; and a cam to move to one of the first presser and the second presser when the one of the first roll and the second roll contacts corresponding one of the wedge and the abutment, the cam to press against the one of the first presser and the second presser in the radial direction of the support shaft to cause the one of the first presser and the second presser to press against and hold an inner circumferential face of a hollow tube of the one of the first roll and the second roll.

* * * * *